US012551766B2

(12) United States Patent
Houser et al.

(10) Patent No.: US 12,551,766 B2
(45) Date of Patent: Feb. 17, 2026

(54) PICKLEBALL NET

(71) Applicant: Composite Recycling Technology Center, Port Angeles, WA (US)

(72) Inventors: Guy M. Houser, Port Angeles, WA (US); Joel S. Lippold, Port Angeles, WA (US); David L. Walter, Port Angeles, WA (US); Mark W. O'Brien, Port Angeles, WA (US)

(73) Assignee: Composite Recycling Technology Center

( * ) Notice: Subject to any disclaimer, the term of this patent is extended or adjusted under 35 U.S.C. 154(b) by 0 days.

(21) Appl. No.: 18/829,745

(22) Filed: Sep. 10, 2024

(65) Prior Publication Data

US 2025/0090920 A1 Mar. 20, 2025

Related U.S. Application Data

(60) Provisional application No. 63/582,545, filed on Sep. 14, 2023.

(51) Int. Cl.
*A63B 61/02* (2006.01)
*A63B 102/08* (2015.01)

(52) U.S. Cl.
CPC ..... *A63B 61/02* (2013.01); *A63B 2102/08* (2015.10); *A63B 2210/50* (2013.01)

(58) Field of Classification Search
CPC ..... A63B 61/02; A63B 2210/50; A63B 61/04; A63B 61/003; A63B 2102/02; A63B 2102/04; A63B 69/38; A63B 2102/08
See application file for complete search history.

(56) References Cited

U.S. PATENT DOCUMENTS 1,959,574 A * 5/1934 Dunscombe ..... A63B 61/02 473/493
2,638,346 A * 5/1953 Stapleton ..... A63B 61/02 211/119.17
4,239,235 A * 12/1980 Torres ..... A63B 69/0097 473/434
4,264,070 A * 4/1981 Torres ..... A63B 69/0097 473/434
4,274,632 A * 6/1981 Jacobs ..... A63B 61/02 473/492
4,489,941 A * 12/1984 Shieh ..... A63B 63/00 473/456

(Continued)

FOREIGN PATENT DOCUMENTS

AU 7685896 A * 6/1997
GB 2549457 A * 10/2017 ..... A63B 61/04

*Primary Examiner* — Eugene L Kim
*Assistant Examiner* — Amir A Klayman
(74) *Attorney, Agent, or Firm* — Daniel A. Thomson; EMERSON THOMSON BENNETT

(57) ABSTRACT

Provided is a net system comprising a frame, a first and second vertical riser each connected to opposite sides of the frame, a top cord connected to the distal end of each vertical riser, a bottom cord connected to a proximal end of each vertical riser, and a net suspended by the top cord. The top cord and bottom cord are balanced in tension by the flexible vertical risers. When the proximal end of the vertical riser is urged towards the center of the net, by action of a hinge between proximal and distal ends of each vertical riser, the distal end of the vertical riser is moved outward, thus tensioning the top cord.

19 Claims, 14 Drawing Sheets

(56) References Cited

U.S. PATENT DOCUMENTS 4,844,455 A * 7/1989 Funkhouser, Jr. ..... A63B 61/02 473/493
4,986,389 A * 1/1991 Halligan, Sr. ..... E04G 21/28 182/138
5,078,365 A * 1/1992 Fultz ..... B25B 25/00 256/37
5,139,256 A * 8/1992 Logan ..... A63B 61/02 473/492
5,215,310 A * 6/1993 Allbright ..... A63B 61/02 473/493
5,407,178 A * 4/1995 Long ..... E01F 13/028 160/354
5,885,176 A * 3/1999 Wong ..... A63B 71/021 473/490
5,947,831 A * 9/1999 McCarthy ..... A63B 63/00 473/197
5,951,417 A * 9/1999 Ha ..... A63B 61/02 473/493
6,021,702 A * 2/2000 Rexroad ..... E04G 21/24 87/13
6,076,448 A * 6/2000 Rexroad ..... E04H 17/161 256/45
6,098,750 A * 8/2000 Reynolds ..... E04G 21/3261 182/138
6,461,258 B1 * 10/2002 Vacanti ..... A63B 61/003 473/494
6,511,390 B2 * 1/2003 Kim ..... A63B 63/00 473/439
7,213,356 B2 * 5/2007 Haggard, Jr. ..... G09F 21/042 40/607.1
7,264,561 B2 * 9/2007 Scarpa, III ..... A63B 71/06 473/494
8,327,565 B2 * 12/2012 Boltz ..... G09F 17/00 40/606.18
8,732,999 B1 * 5/2014 Hughes ..... G09F 15/0025 160/329
8,893,417 B2 * 11/2014 Miller ..... G09F 7/18 116/28 R
9,759,011 B2 * 9/2017 Leavitt ..... E06B 9/04
9,808,697 B2 * 11/2017 Dorsett ..... A63B 69/0097
9,908,023 B1 * 3/2018 Hamm ..... A63B 63/00
10,010,775 B2 * 7/2018 Dinoffer ..... A63B 61/04
10,226,679 B2 * 3/2019 Nelson ..... A63B 61/00
11,819,747 B2 * 11/2023 Fedon ..... A63B 71/023
2007/0087869 A1 * 4/2007 Lin ..... A63B 61/02 473/492
2012/0208658 A1 * 8/2012 Christgau ..... A63B 63/00 428/223
2021/0008432 A1 * 1/2021 Ward ..... A63B 61/003
2022/0193512 A1 * 6/2022 Callender, Jr. ..... A63B 61/02

* cited by examiner (Prioir Art)

PICKLEBALL NET

This application claims priority to a provisional patent application, Ser. No. 63/582,545, filed Sep. 14, 2023, the contents of which are hereby incorporated by reference. This disclosure is directed to a net system for use when playing sports such as pickleball or tennis. However, the net system is not limited to those sports.

I. BACKGROUND

Pickleball is a rapidly growing indoor/outdoor sport played at a slower pace and with significantly less physical demands than tennis, leaning towards a demographic weighted in favor of seniors and an elderly playing population. The playing area is closer in size to badminton than tennis, and often two or three pickleball courts can be placed in the space previously occupied by one tennis court. As players advance in their skill level, they become more demanding in the kind of netting tension they are playing with as well as the precision of the netting height at various points across the netting, which are a specification of the sporting body. They want the ball to react consistently if it hits the top of the netting. The current state of the art response is found in a permanent system that is sunk into the ground and uses a cable and winch system that provides very stiff tension across the netting surface. Because there is a desire by resort owners and athletic clubs to have versatility with the playing surfaces at their facilities, there is a need for a netting system that provides the netting tension of a permanent net while still providing mobility so the system can be moved out of the way when not in use. This allows resorts and athletic clubs to be able to easily switch between guests or members playing pickleball, badminton, volleyball, tennis or basketball on the same court surface.

Semi-permanent systems are commercially available today. They utilize a metal frame that supports an exterior winch system connected to a cable that runs through the top tape of the netting. The systems are heavy and weigh in excess of 200 pounds. They require significant assembly and disassembly when broken down. They can have wheels attached to move the system on the court, but the wheels must be manually removed through the disassembly of mechanical fasteners in order to utilize the system on a playing surface. Such systems can be found in the patent literature and generally have exhibited several important disadvantages when reduced to practice.

Disadvantage 1 is the weight. With existing systems weighing in excess of 200 pounds, it could be unsafe and impractical for one or two persons to try to handle the unloading and set up of the system on their own. Disadvantage 2 is that the bottom frame is in contact with the court surface. Because of the weight of the system and because the frame is in intimate contact with the playing surface, the playing surface could get damaged if the system is moved or dragged across the surface without putting the wheels back on the system. Disadvantage 3 is that players also become frustrated with these systems because the bottom frame which runs parallel to the playing surface, sits on the surface and blocks the ball from going underneath the net. This means players often have to move from the back of the court up to the netting in order to retrieve a ball that has gotten stopped there. Disadvantage 4 is that because these systems cannot be broken down into small enough components, these systems must be shipped on a pallet which requires handling equipment by the end customer and often extend the length of time it takes to deliver such systems to the end user.

A further detractor to the usage of existing net systems is the requirement for storage in situations where the net has to be removed in short order for transition of the playing surface to other demands. This commonly occurs in facilities with shared courts and the difficulty in current semi-permanent net systems breakdown and re-assembly has led to simply leaving the net erected and finding a large enough storage area to accommodate it.

Tensioning system of current semi-permanent net systems use a cantilever beam approach to tension the top cord (cable) to suspend the net. The tension in the top cord can be upwards of 400 lbs, and induces a significant moment at the connection point of the post to the frame. This moment will then translate into high bending loads in the frame; thus, requiring heavy, large-scale structural members to construct the frame. This rigidity requirement also reduces the frame's ability to be broken into sections for ease of transport or storage. The weight and dimensions of several of these components limits the utility of these net systems, particularly where storage space for fully assembled nets is limited. What is needed is a net system that solves these problems and disadvantages.

II. SUMMARY

In accordance with one aspect of this disclosure, provided is a net system comprising a frame, at least one vertical riser attached to the frame, a top cord attached to a proximal end of the vertical riser, a bottom cord attached to a distal end of the vertical riser, and a net that is suspended by the top cord.

In accordance with one aspect of this disclosure, provided is a net system, usable and developed primarily for pickleball (but applicable to many other sports requiring separation of participants whether by rule or otherwise as is evident to those practiced and experienced in the field) has been developed and reduced to practice that combines several common approaches into a novel system that has not been previously conceived. Functionality has been demonstrated in the following areas: 1) Set-up and tear-down (in under 1 hour vs. at least 2 hours for state-of-the-art nets); 2) Weighs under 100 pounds vs. 200 pounds for state-of-the-art systems. 3) Does not have a bottom frame that sits on the playing surface like existing state-of-the-art systems. This allows balls to roll underneath the system and avoids possible damage to playing surfaces if the system is dragged across the surface; 4) Has well defined, repeatable and settable net tape heights as required by playing rules and thus meets all regulations for play; and 5) Has high net tension in order to provide players with a net stiffness that is similar to a permanent system. The net system of this disclosure is lighter than prior art net systems and more convenient to handle. As such, this disclosure's net system has lower transport and shipping costs. The net system of this disclosure can be checked on most airlines.

The present disclosure addresses issues with former approaches to semi-permanent nets for sports and other applications in that the net is developed as a component of a tension-strung bow, including a wire rope (top cord) that is pulled under high tension so that the net is hung from this wire rope and the compound bow itself made up of vertical spring like posts at each distal end all connected to a base. The stiffness (thus flexion) of the netting is set by the lever system that is hidden inside the post/frame connection. This keeps the lever out of view and out of possible contact with a player or bystander. The vertical posts or Bows and frame can be fabricated from flat plate or open structural sections (I-beam, c-channel, etc.). Individual lengths of the bottom frame are such that the breakdown of components fits easily in a carry bag or into a box for initial shipping to the customer. In the first reduction to practice, five individual members were used to make up the twenty-foot nominal length of the bottom frame, however in various embodiments any number of sections could be considered without limiting the functionality of this disclosure.

The current embodied system utilizes a two-cord (cable) and a rigid frame brace crossbeam to produce the required tension (F) in the top cord. Because the tension in the top (F) and bottom (P) cords are balanced, only compressive loads (C) are introduced to the frame base crossbeam. Thus, the frame base crossbeam's primary role is to resist buckling and the balanced loads from the top and bottom cord serve to eliminate bending loads and moment loads at the frame base crossbeam to frame vertical riser assembly joints. This significantly reduces the need for large structural members and enables a significant reduction in mass and complexity of the frame distal end attachments. Compressive loading in the frame has an ancillary benefit in that it forces frame members together, which allows for interlocking of modular pieces, thus making it simpler to sectionalize the frame for transport or storage. In one or more aspects of this disclosure, the frame of the net system does not comprise friction-fit swaged ovalized, elliptical, or rectangular tubing. These common approaches to the tubing are a significant shortcoming of current designs, as any damage to the peripheral edges of the tube-to-tube insert fits will typically render them unusable, and the system mass is increased by the need to have these connections all resist the bending and twisting. Without bending moments introduced into the frame base crossbeam, the durability of the system is improved as noted, and the frame base crossmember can be set to any convenient height off the playing surface as desired for improved playability without need for additional support along the length such as intermediate legs or support braces. The mass reduction and simplified design of the components enabled by this approach solve one of the more significant drawbacks to current state-of-the-art systems.

Tensioning of the top cord in current systems utilizes a mechanical lever system that is bulky and heavy. In the current embodied system, the length of the bottom cord is adjusted through a screw and fixed nut system, or through any one of a number of similar methods as can be envisioned. The frame length and top cord have a fixed length. This approach allows for the simple installation and removal of the net for transport or storage. Similar approaches could include adjusting the frame length or top cord length without impacting functionality, however the ease of utilizing the base cord as adjustment assists in the rapid assembly of the system. In the current embodied system, the frame vertical riser (referred to hereinabove as a post or bow) is an elastic member with high stiffness, and its deflection is used to set the precise tension in the top cord. The frame vertical riser does not have to be elastic, but could be rigid and discrete springs incorporated to set tension in the bottom cord or frame. Other methods of setting net tension can easily be envisioned by one practiced in the art and can be developed to serve the same function as set forth in this disclosure.

In this disclosure, the top and bottom cord lengths are previously set by the user as noted above, and the frame vertical risers are the attachment points for these top and bottom cords. An action that causes the frame vertical riser distal ends to be moved outward from the plane of the net will thus cause the net to be tensioned at both the top and bottom cord. This disclosure has the connection from the frame vertical riser to the frame base cross-beam as a pinned joint, resulting in the frame vertical riser being able to rotate about the joint location and thus automatically provide balanced top and bottom cord tension. The disclosure does not rely on a specific method of causing the action that results in moving the frame vertical riser ends outwards to provide this tension, but has been reduced to practice via an independent pulley approach for the purpose of concealing the tightening mechanism within the frame base crossbeams. The action can be just as easily provided by a number of means evident to one practiced in the art. The result of this configuration approach is that net assembly and disassembly is made substantially easier, thus solving one of the most significant issues in semi-permanent portable net systems. Under the current embodiment, the frame vertical risers are outwardly (from the perspective of the net) curved and fabricated from a carbon fiber composite, thus ensuring that as the bow tensioning cord is pulled towards the center of the net system, there can only be movement of the frame vertical riser distal ends away from the net centerline. Although the embodiment used carbon composite for its qualities of light weight and high stiffness, several other major structural materials could be envisioned in other embodiments such as steel, aluminum or other light metals, or other structural materials capable of providing the resistance to loads and structural performance necessary.

What is disclosed is the following: a semi-permanent net system for pickleball and other net games comprising: a rigid base cross frame in compression pinned to vertical side arms; vertical side arms which act as end posts as well as mechanical springs to impart tension to the top and bottom cords; a rigid base cross frame with distal ends shaped so as to allow the main frame to be positioned above the playing surface while placing the pivot point for the mechanical spring in the optimal location for tension control; a system whereby the top and bottom cord tensions are set by aforementioned mechanical spring and are thus balanced and equal; a support base on casters to enable rolling and movement of the portable net system; a tensioning device to impart an adjustable load into the mechanical spring to set top and bottom cord tensions to those desired by players.

Still other benefits and advantages of this disclosure will become apparent to those skilled in the art to which it pertains upon a reading and understanding of the following detailed specification.

III. BRIEF DESCRIPTION OF THE FIGURES

The disclosure may take physical form in certain parts and arrangement of parts, aspects of which will be described in detail in this specification and illustrated in the accompanying figures which form a part hereof.

IV. DETAILED DESCRIPTION

Figure 1:
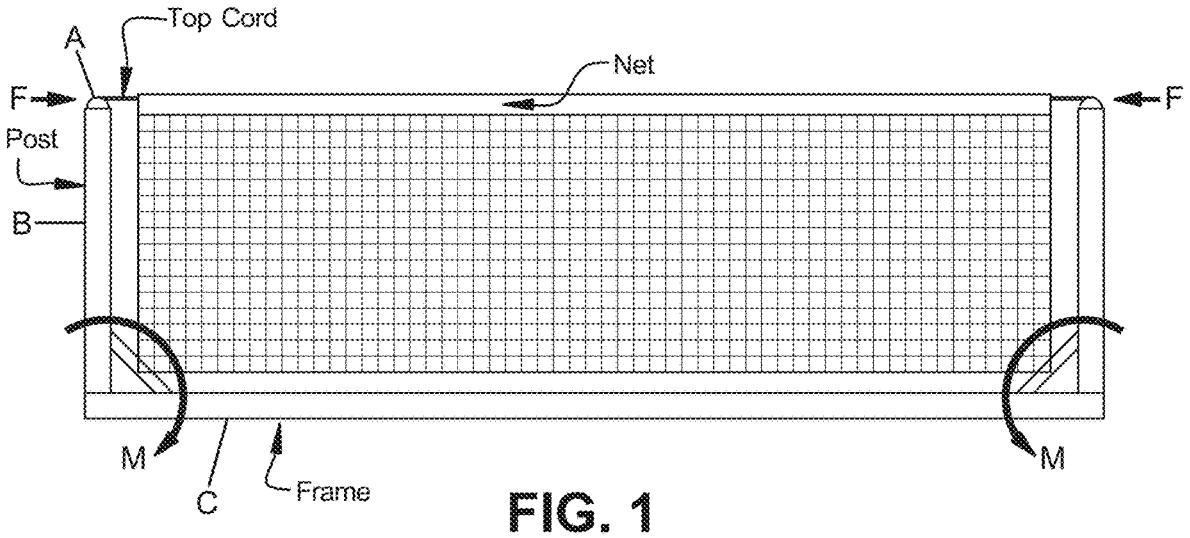
FIG. 1 is a pickleball net from the prior art.

Referring now to the figures wherein the showings are for purposes of illustrating aspects of the disclosure only and not for purposes of limiting the same, FIG. 1 shows a prior art net. The prior art net has a top cord A and posts B. The top cord A is attached to posts B. The posts B are attached to a frame C. In prior art nets, the top cord A is kept at a certain height by tensioning it between the posts B. The tension of the top cord A urges the post B inward. As the post B resists this urge, it creates a moment M. To resist the moment M, the posts B and the frame C must be strong, rigid members. The posts B and the frame C are often heavy as they are engineered to have sufficient strength to resist the moment M.

Figure 2:
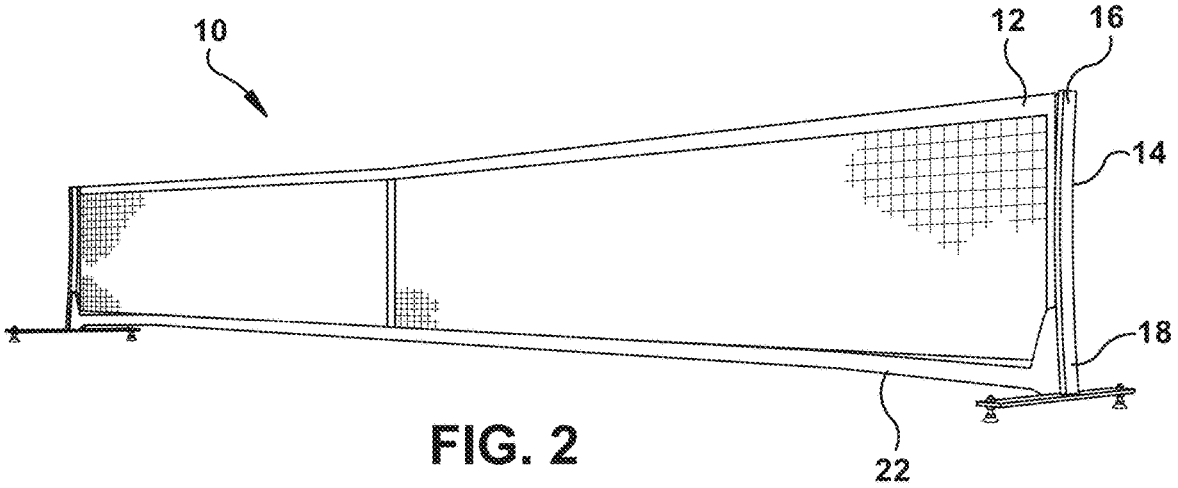
FIG. 2 is a perspective view a net system.

FIG. 2 shows a perspective view of a net system 10. The net system 10 may include a top cord 12, two vertical risers 14, a distal end 16 of each vertical riser 14, a proximal end 18 of each vertical riser 14, a bottom cord 20 (not shown) and a frame 22.

Figure 3:
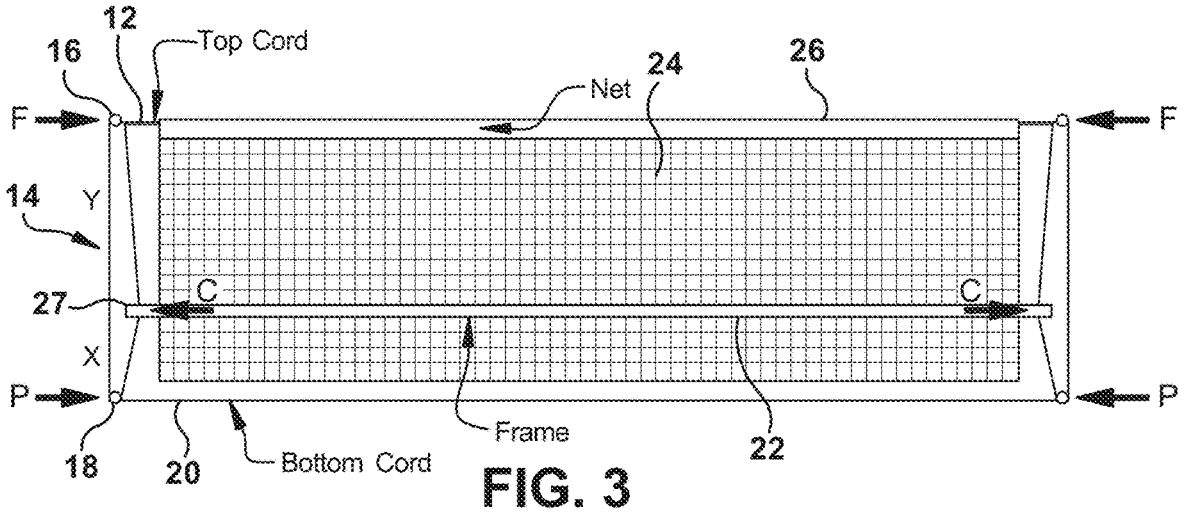
FIG. 3 is a front view of a net system.

FIG. 3 shows a front view of the net system 10. The net system 10 may include a top cord 12 connected to a vertical riser 14. The vertical riser 14 may be connected to a bottom cord 20. The net system 10 may have a vertical riser 14 connected to a frame 22. The net system 10 may have a net 24, and the net 24 may have a net sleeve 26. The top cord 12 runs between the two vertical risers 14, and the top cord 12 may be run through the net sleeve 26, thereby suspending the net 24. The frame 22 may connect to the vertical riser 14 through a hinge 27.

The connection of the top cord 12 to the vertical riser 14, and the vertical riser 14 to the bottom cord 20 makes it so that the tension of the top cord 12 and the bottom cord 20 is balanced. Because the tension is balanced, the frame 22 is only subject to a compressive load C. The role of the frame 22 is only to resist buckling and to balance loads from the top cord 12 and the bottom cord 20. This is in stark contrast to prior art nets where the posts B and the frame C were required to resist moment M and thus had to be engineered thusly. In the net system 10, the vertical riser 14 and the frame 22 can be made of lightweight and relatively weaker material. The frame 22 does not suffer the significant bending and moment loads that prior art nets must withstand. This drastically reduces the weight of the net system 10. Further, because the frame 22 does not suffer the significant bending and moment loads prior art nets must withstand, the frame 22 can be made of flat plate or open structural sections such as I-beam or C-channel. Because the top cord 22 is connected to the vertical riser 14, as the bottom cord 20 is shortened or lengthened, the tension increases or decreases, respectively.

Figure 4:
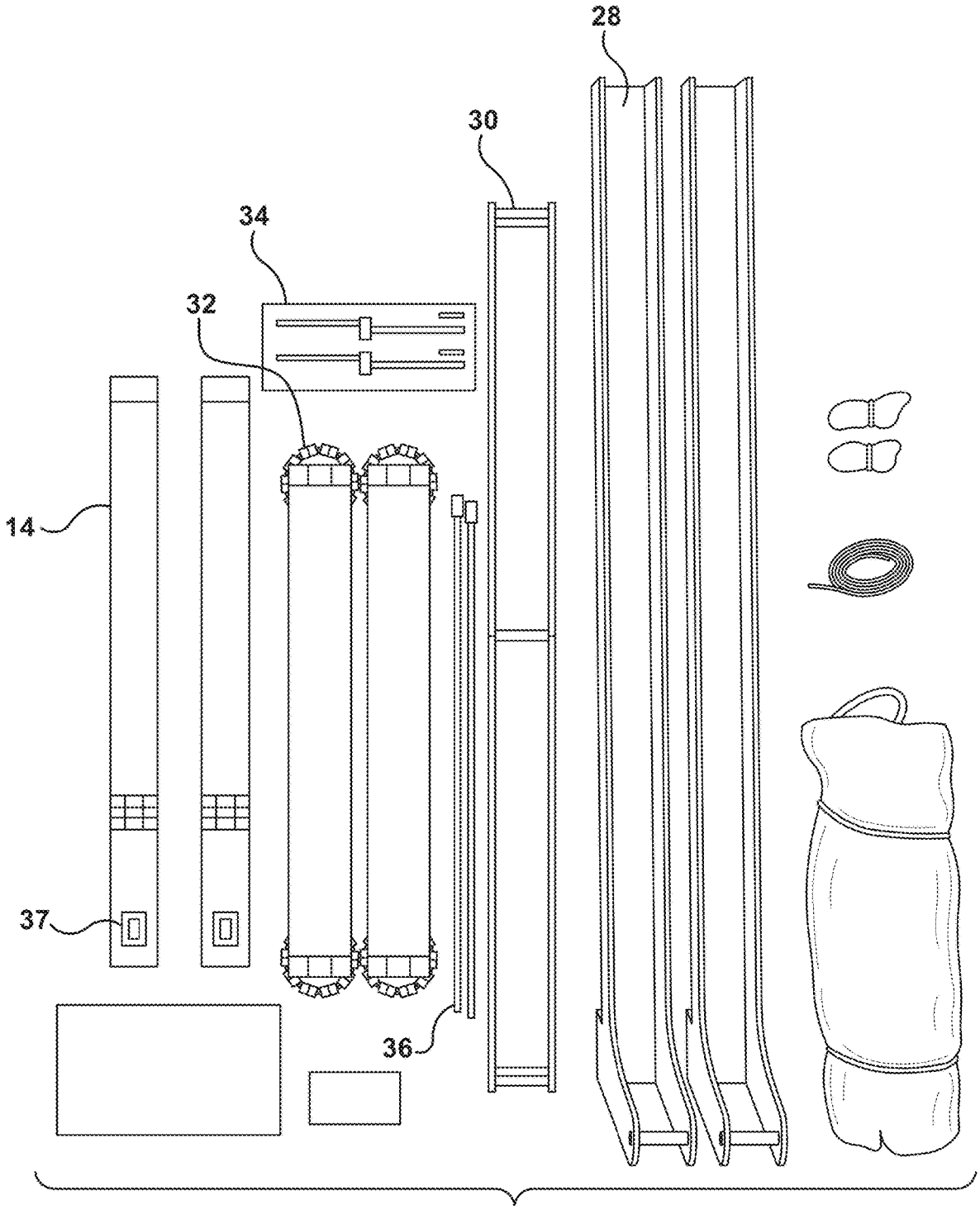
FIG. 4 shows the components of a net system.

FIG. 4 shows components of the net system 10. The net system 10 may include two end beams 28, a center beam 30, two legs 32, two tension blocks 34, two net tension rods 36, and two vertical risers 14 with vertical riser apertures 37.

Figure 5:
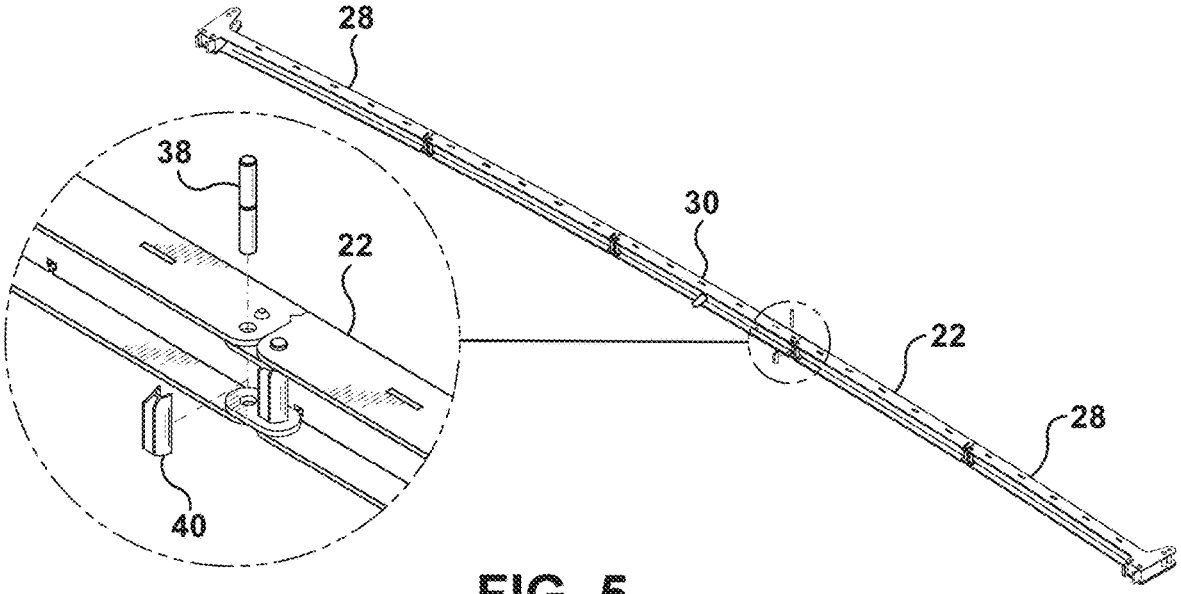
FIG. 5 shows a frame and links thereto.

FIG. 5 shows the frame 22. In one or more aspects, the frame 22 comprises a center beam 30 connected to two end beams 28. The center beam 30 and the end beams 28 are connected by pins 38 and link clips 40. The pins 38 are inserted into apertures on the sides of the center beam 30 and the end beams 28. Because the frame 22 is modular, it can be dismantled for easy transportation. As shown in FIG. 5, the way that the beams are connected with the pins 38 and the link clips 40 to create the frame 22 is especially advantageous. The arrangement allows the frame 22 to resist bending motions exerted on it. The connection of the center beam 30 and the end beams 28 may be done by other methods known to a person of skill in the art. In one aspect, the frame 22 comprises the center beam 30 and the two end beams 28; however, in other aspects the frame 22 may include more segments or less segments. This disclosure is not limited to the frame 22 comprising three total segments.

Figure 6:
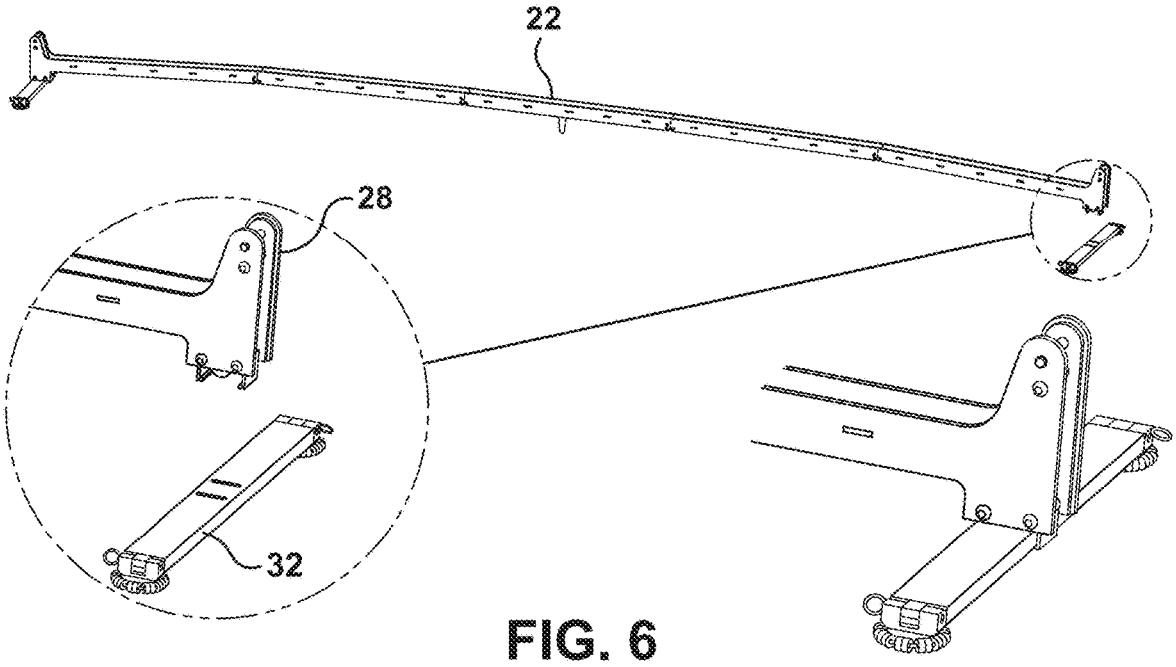
FIG. 6 shows a frame and a leg.

FIG. 6 shows assembled end beam 28 connected to leg 32. End beam 28 of frame 22 has leg mount clips, and leg 32 has leg alignment slots. Frame 22 may be connected to leg 32 by other means that are known to a person of ordinary skill in the art. FIG. 6 also shows that frame 22 may be arched.

Figure 7:
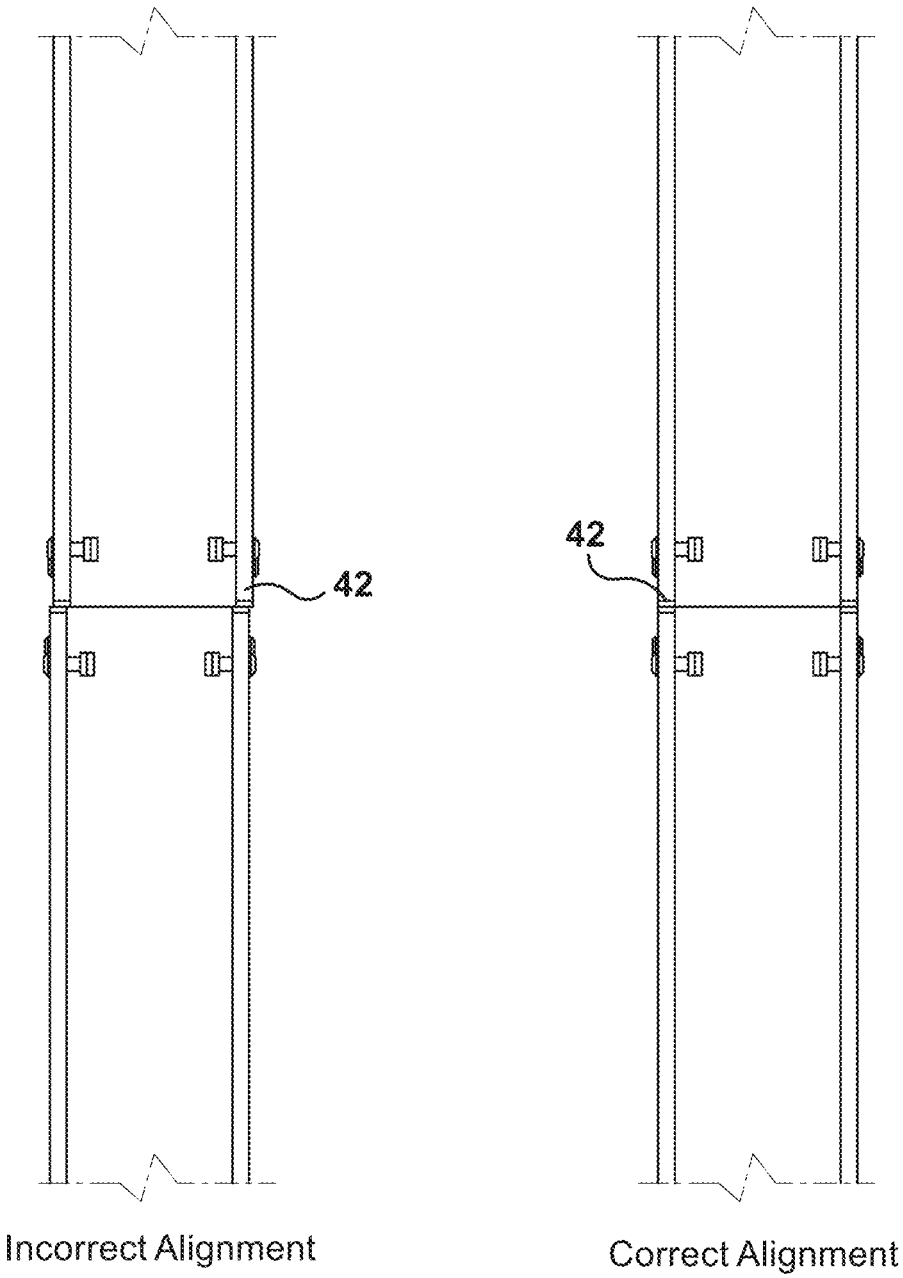
FIG. 7 shows a top view of the multiple beam flanges in the frame.

FIG. 7 shows a top view of beam flanges 42. To make frame 22 arched, a person lifts and flexes the components of frame 22 until beam flanges 42 are aligned.

Figure 8:
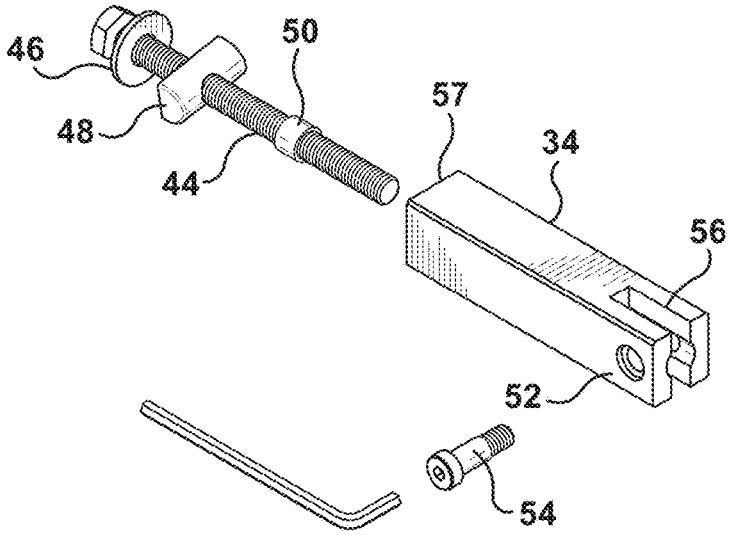
FIG. 8 shows a perspective view of a tension block and a tensioning component.
Figure 9:
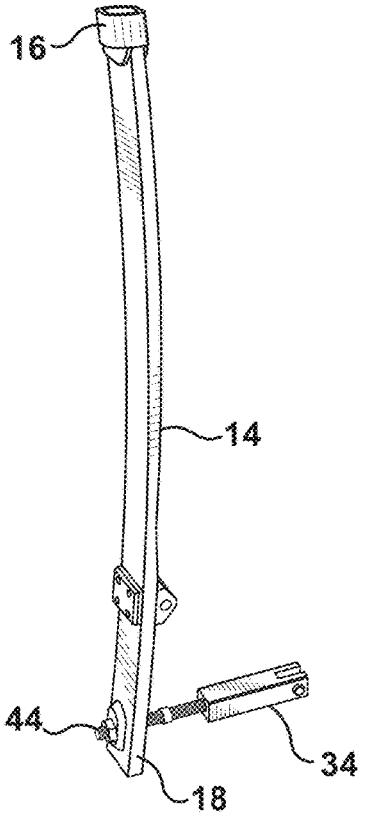
FIG. 9 shows a perspective view of a vertical riser, a tension block, and a tension screw.
Figure 10:
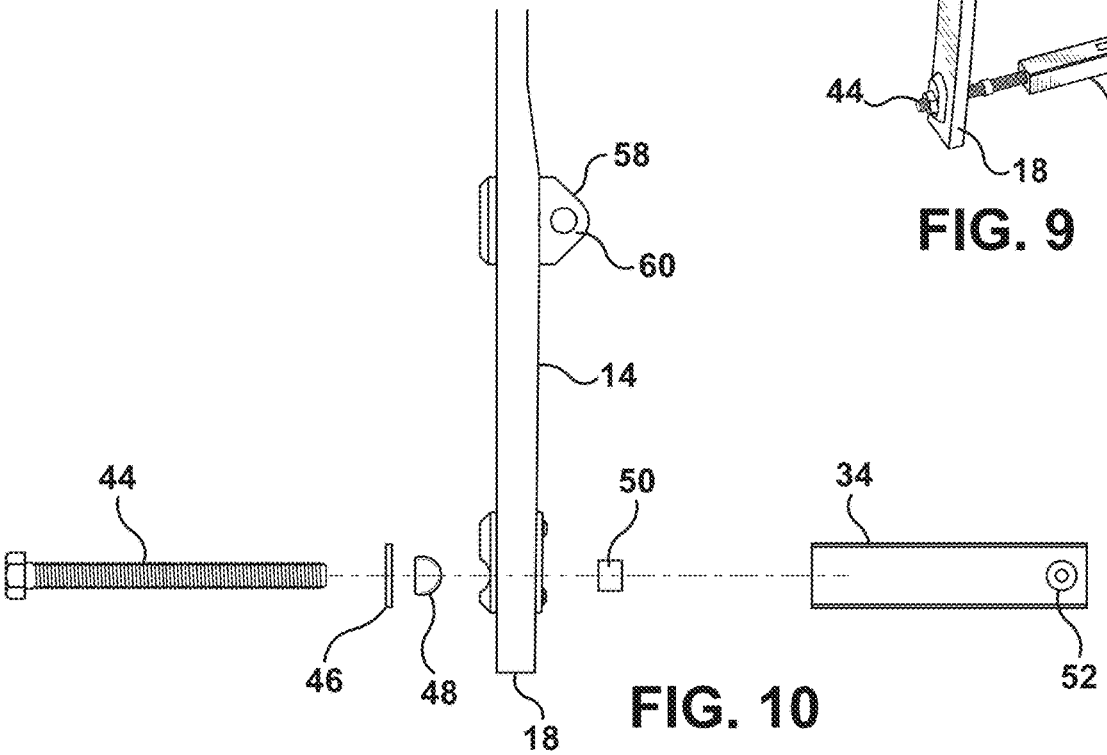
FIG. 10 shows a front view of a tension screw, a vertical riser, and a tension block.

FIGS. 8, 9, and 10 show the assembly of a tensioning component 44, a vertical riser 14, and a tension block 34. FIG. 8 shows a perspective view of the tension block 34 and the tensioning component 44. FIG. 9 shows a perspective view of the tensioning component 44, the vertical riser 14, and the tension block 34. FIG. 9 shows that the vertical riser 14 may be curved. FIG. 10 shows the sequence for assembly of the tensioning component 44, the vertical riser 14, and tension block 34. With reference to FIG. 10, the figure shows the tensioning component 44, a washer 46, a barrel washer 48, a proximal end 18 of the vertical riser 14, a bushing 50, the tension block 34, an eye 52 of the tension block 34, a cord retaining component 54 inserted thereto, and a socket 57 of the tension block 34. FIG. 10 also shows a vertical riser knuckle 58 with an aperture 60. Returning to FIG. 8, a socket 57 is not shown in FIG. 8, however it is clear that for the tensioning component 44 to insert into the tension block 34, the tension block 34 must have a socket. FIG. 8 shows a slot 56, which is visible from this view. The tensioning component 44 may be a threaded screw and may be inserted into the tension block 34, which also may be threaded so as to retain the tensioning component 44. When the tensioning component 44 is screwed into the threaded retaining block 34, it brings the two pieces closer together, thereby establishing tension. The cord retaining component 54 may be a threaded screw, and the aperture 52 may be threaded to retain the cord retaining component 54. Once the assembly of the tensioning component 44, the vertical riser 14, and the tension block 34 is done, it can be installed into the end beam 28 as shown in FIG. 11.

Figure 11:
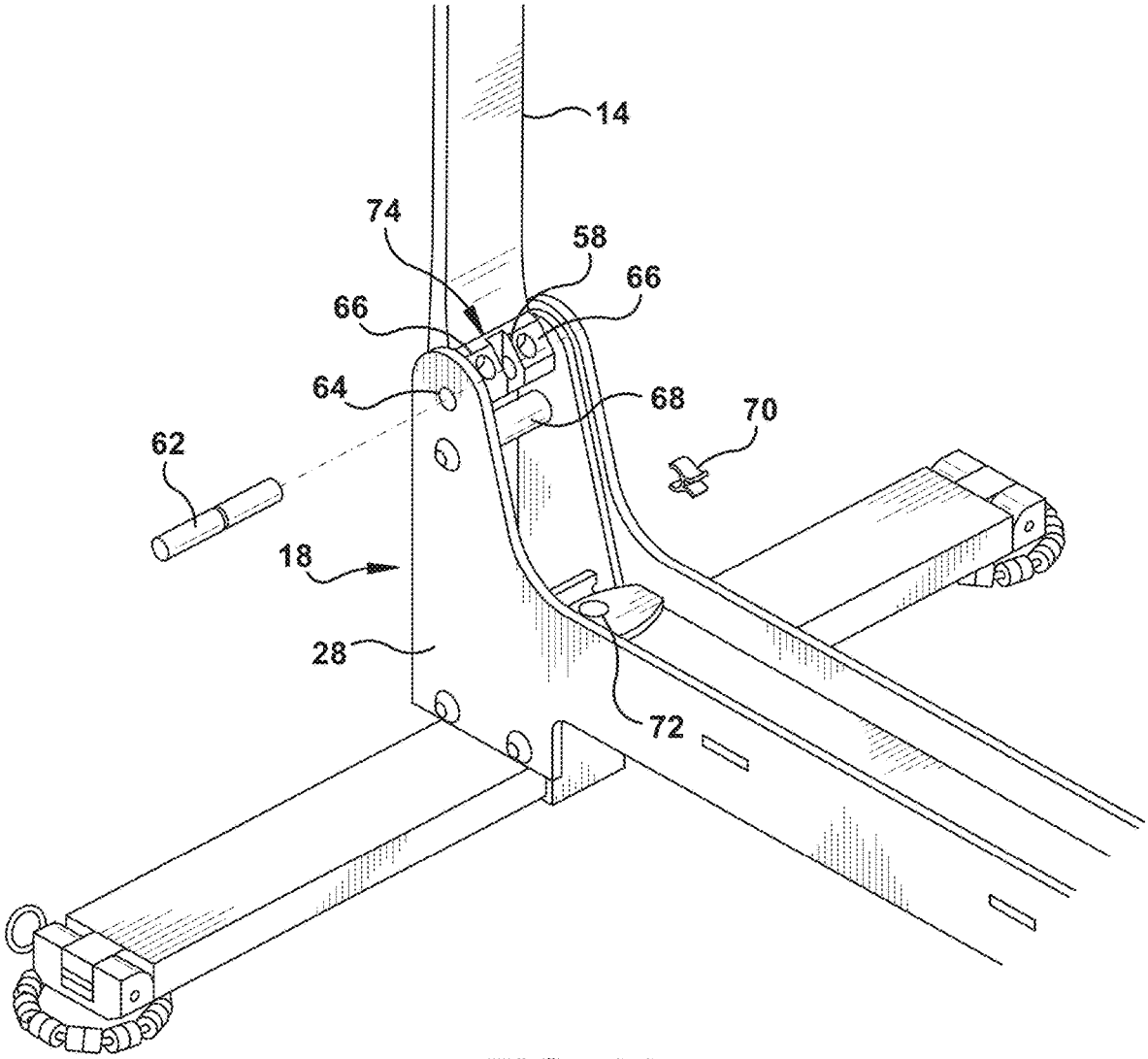
FIG. 11 shows a perspective view of a leg, an end beam, and a vertical riser that is being assembled into the end beam using a pin.

FIG. 11 shows the installation of the vertical riser 14 into the end beam 28. FIG. 11 shows a hinge pin 62, an aperture 64, an end beam knuckles 66, a vertical riser knuckle 58, a connecting piece 68, a hinge clip 70, and a net tension rod socket 72. Once the vertical riser 14 is installed into the end beam 28, it creates the knuckle hinge 74 via the hinge pin 62, the end beam knuckles 66, and the vertical riser knuckle 58. This allows the vertical riser 14 to rotate about the knuckle hinge 74. The hinge clip 70 locks the hinge pin 62 in place. The end beam 28 as shown is tall enough to accommodate the proximal end 18 of the vertical riser 14; in other aspects, the end beam 28 may be taller so that the vertical riser 14 is positioned higher off the ground. This would increase the height of where the net 24 is positioned, which would enable the net system 10 to be a volleyball or badminton net. Further, in some aspects, the vertical riser 14 could be longer, and this would enable the net system 10 to be a volleyball or badminton net.

Figure 12:
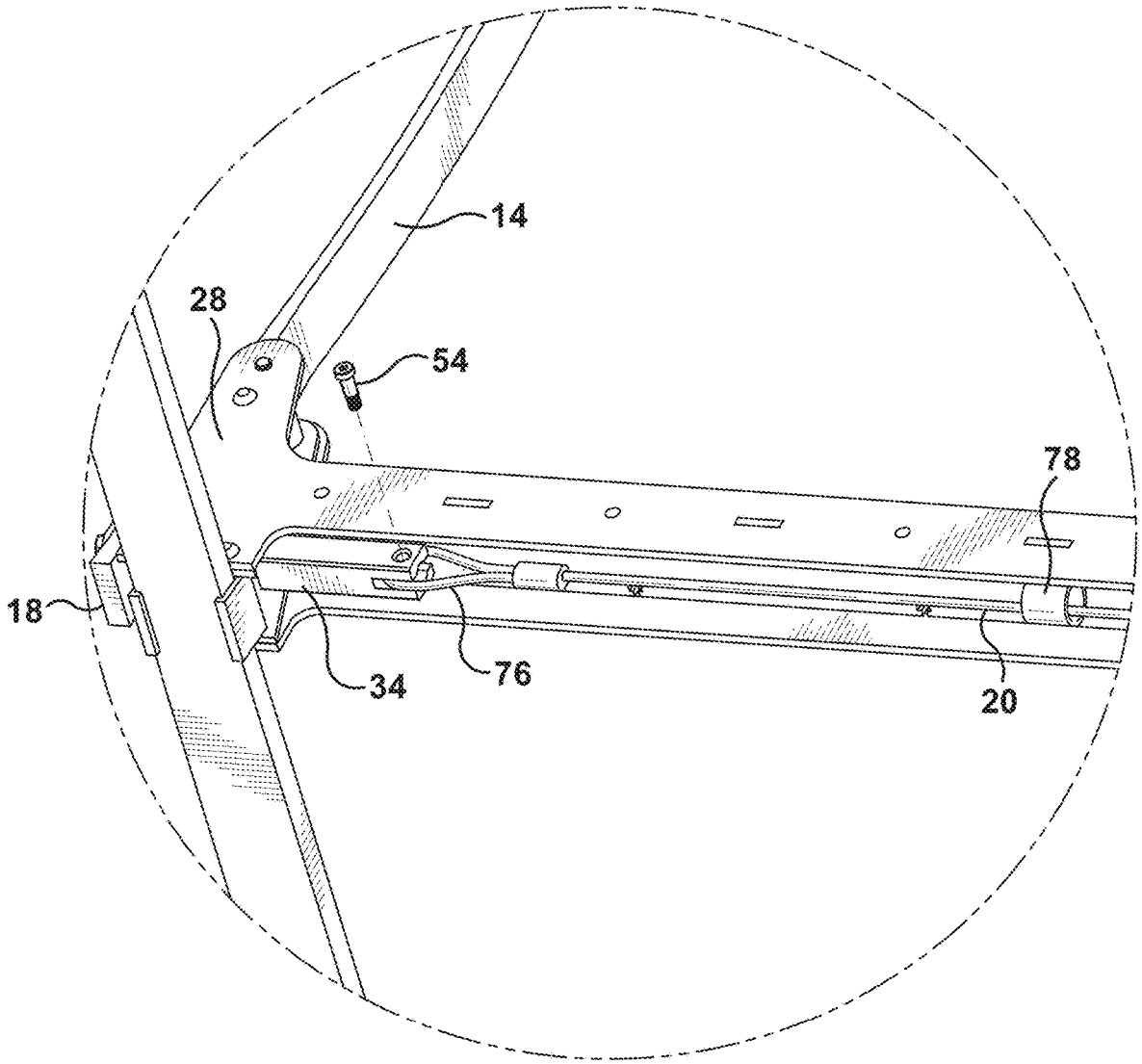
FIG. 12 shows a bottom perspective view of a beam, a tension block, and a bottom cord.

FIG. 12 shows the installation of the bottom cord 20 into the tension block 34. FIG. 12 shows the cord loop 76, and further shows the bottom cord 20 inside the cord guide 78. Once the cord retaining component 54 is installed into the tension block 34, the bottom cord 20 is retained. FIG. 12 shows the bottom cord 20 under no or moderate tension as the tensioning component 44 has not yet been significantly inserted or screwed into the tension block 34 to thereby push the proximal end 18 of the vertical riser 14 into the end beam 28 and thereby create the tension in the net system 10.

Figure 13:
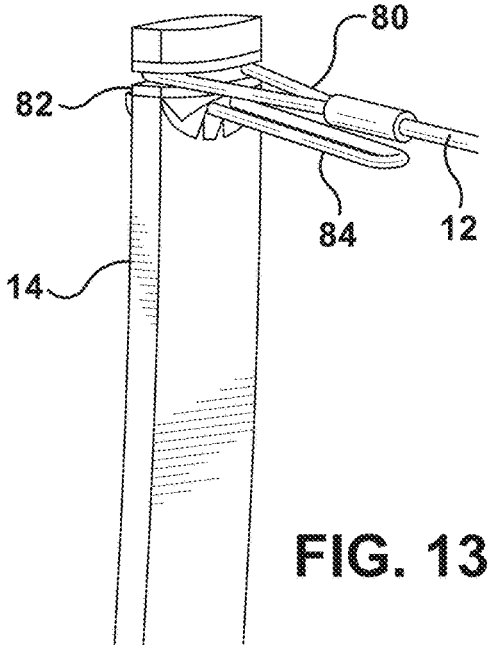
FIG. 13 shows a distal end of a vertical riser with a top cord looped around it.

FIG. 13 shows the vertical riser 14 with the top cord 12 installed onto it. FIG. 13 also includes a cord ferrule 82 and a net tension rod holder 84. In one aspect, the top cord 12 terminates around the distal end 16 of the vertical riser 14. This is different than most prior art nets that create tension on a top cord by connecting their top cord to a winch.

Figure 15:
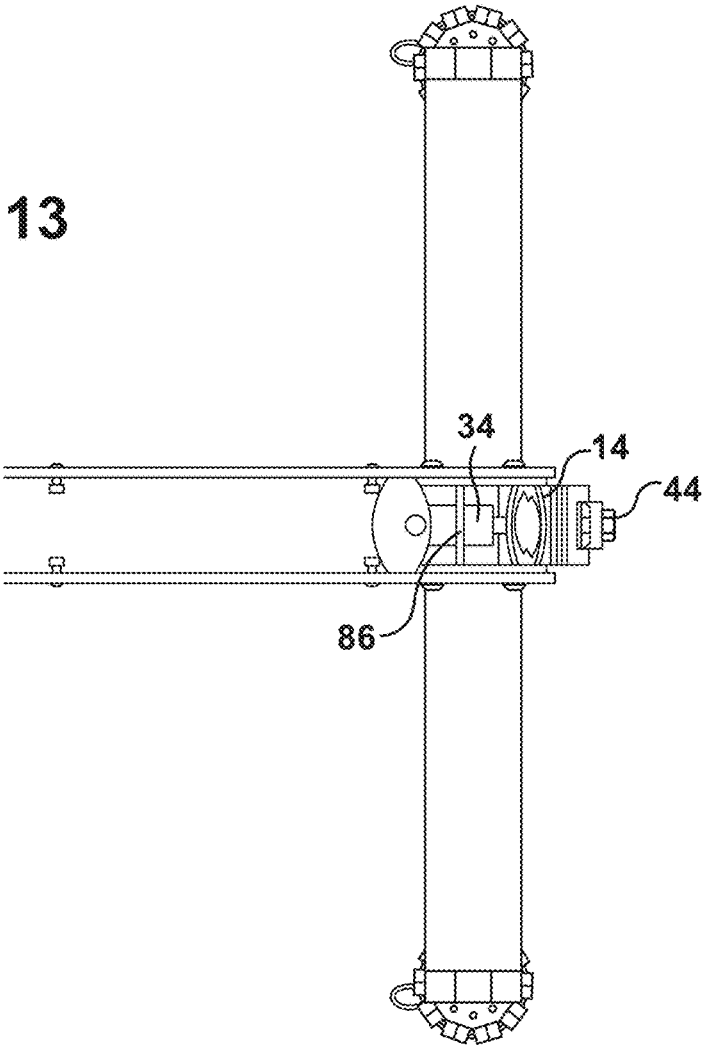
FIG. 15 shows a top-down view of a leg, a vertical riser, and a tension block.
Figure 14:
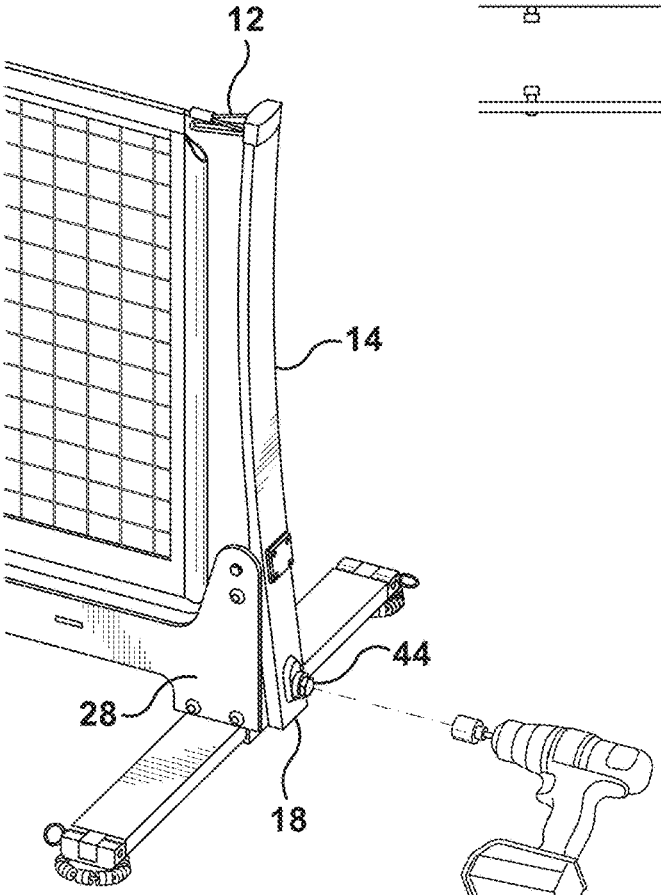
FIG. 14 shows an end beam with a vertical riser installed into it before a tension screw has been fully tightened

FIG. 14 shows the net system 10 with the tensioning component 44 installed through the vertical riser aperture 37. FIG. 15 shows a bottom-up view of the assembly of the tensioning component 44, the vertical riser 14, and the tension block 34. The end beam 28 may have a keyhole plate 86. The tensioning component 44 and the tension block 34 may pass through the keyhole plate 86 as the tensioning component 44 is tightened.

Figure 15A:
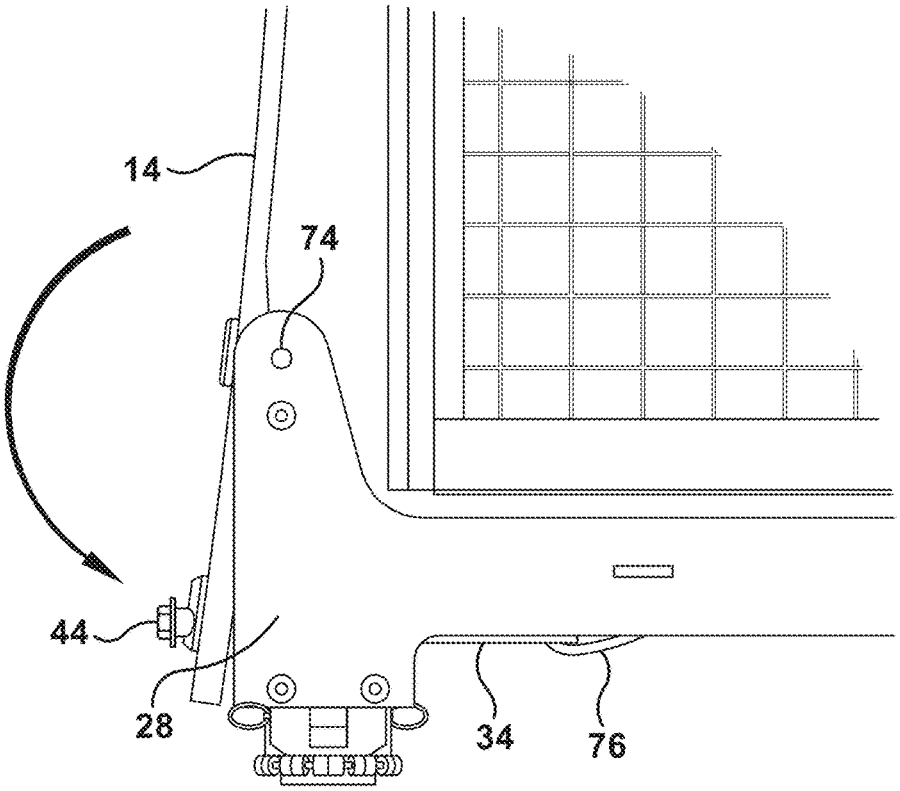
FIG. 15A shows a front view of a vertical riser that has yet to be tightened to an end beam.

FIG. 15A shows the vertical riser 14 before the tensioning component 44 has been tightened. Note that the vertical riser 14 leans towards the center of the net 24 before the tensioning component 44 is tightened.

Figure 15B:
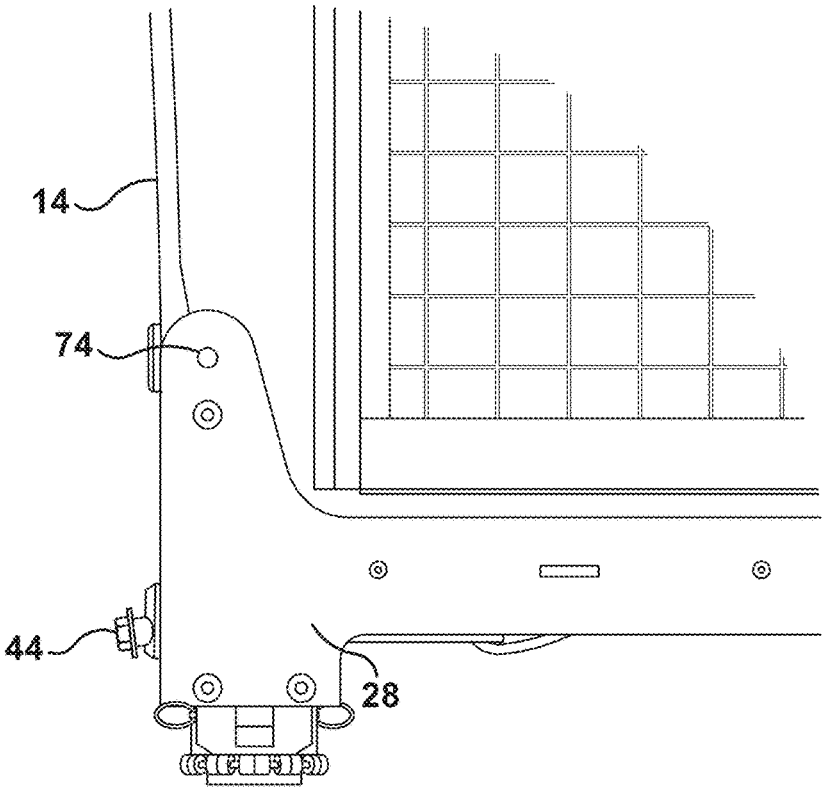
FIG. 15B shows a front view of a vertical riser that has been tightened to an end beam.

FIG. 15B shows the vertical riser 14 after the tensioning component 44 has been tightened. In one aspect, the tensioning component 44 is tightened so that the proximal end 18 of the vertical riser 14 is flush with the end beam 28. In one or more aspects, the proximal end 18 of the vertical riser 14 is tightened so that the tensioning component 44 and the tension block 44 touch each side of the proximal end 18. The vertical riser 14 is able to rotate as it is tightened due to the knuckle hinge 74. In one aspect, the vertical riser 14 is oriented perpendicular to the ground. In another aspect, the vertical riser 14 leans away from the center of the net 24. This creates balanced tension between the top cord 12 and the bottom cord 20. In one aspect, when the tensioning component 44 is tightened, the proximal end 18 of the vertical riser 14 is pushed inward and simultaneously the distal end 16 of the vertical riser 14 is moved outward, both with respect to the center of the net 24. Both the top cord 12 and the bottom cord 20 are significantly tensioned after tightening. Importantly, the top cord 12 is significantly tensioned. This hangs the net 24 at the appropriate height for pickleball, tennis, or other net sports. In one aspect, the vertical riser 14 includes a flexible material such as a carbon fiber composite. This enables the vertical riser 14 to act as a spring and balance the tensions between the top cord 12 and the bottom cord 20. The vertical riser 14 may be made of a stiff, nonflexible material; in this case, springs are incorporated into the assembly of the tension block 34, the vertical riser 14, and the tensioning component 44. The springs balance the tension between the top cord 12 and the bottom cord 20. In one aspect, the vertical riser 14 on a first side of the net 24 is flexible and acts as a spring and the second vertical riser 14 on the second side of net 24 is not flexible or is firm. In one aspect, once the vertical riser 14 is tensioned, the net 24, as measured from the ground and measured at the sides of net 24, is 36 inches in height. By attaching a center height strap at the center of the net 24, the center of the net 24 can be brought down to 34 inches.

Figure 17:
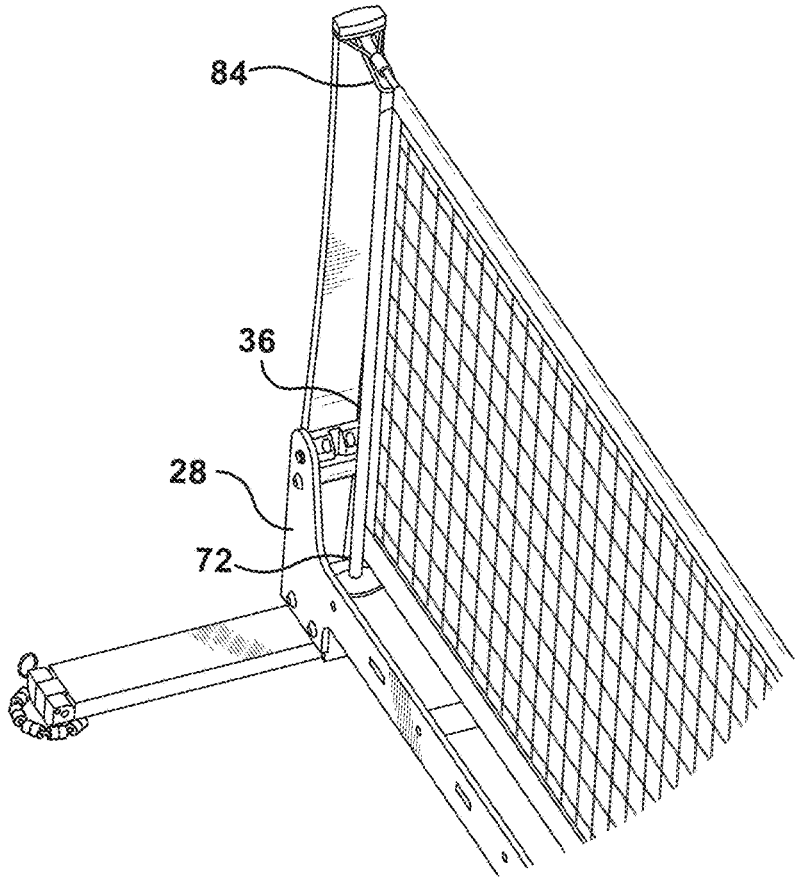
FIG. 17 shows a perspective view of a net tension rod installed into an end beam.
Figure 16:
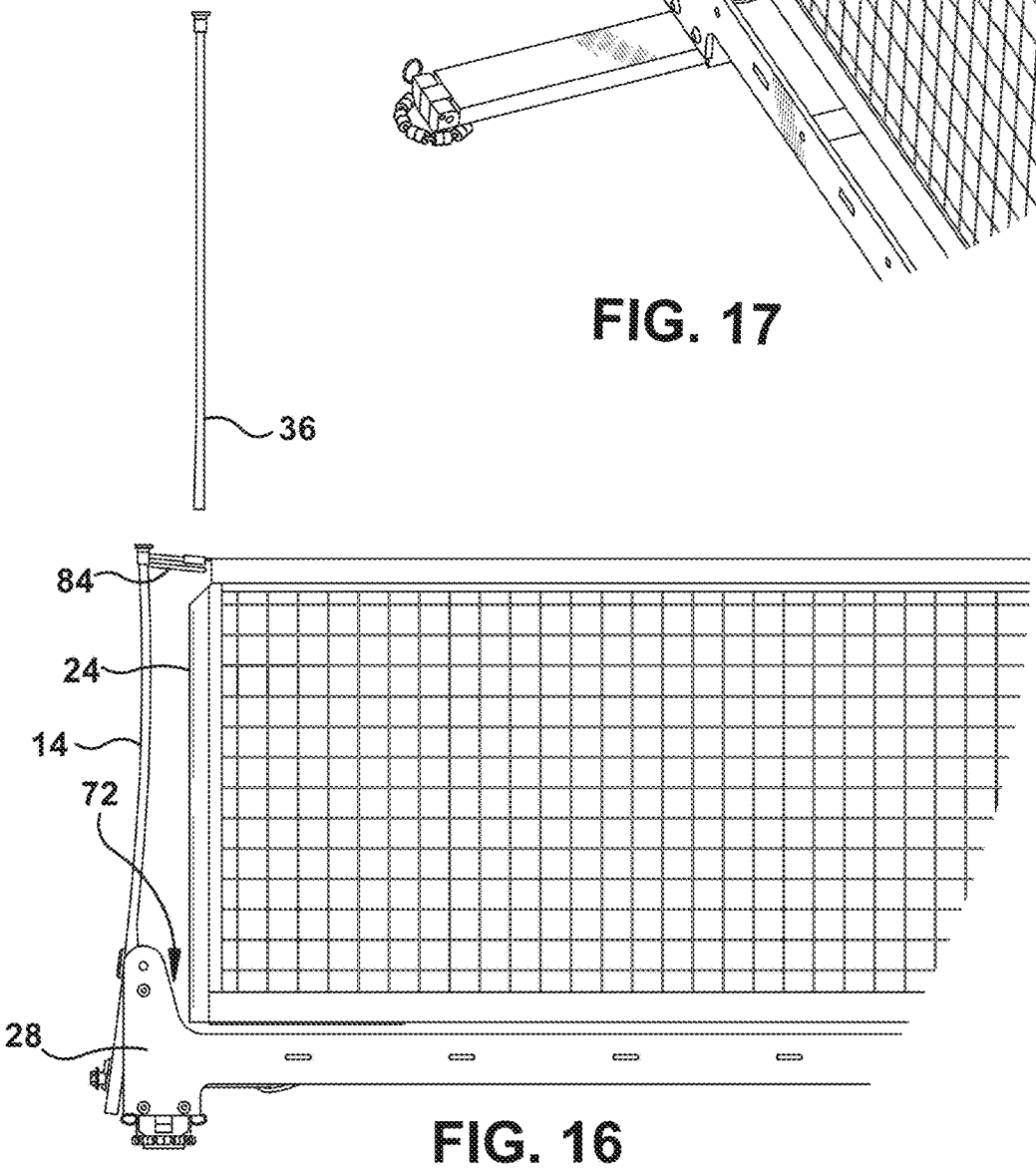
FIG. 16 shows a side view of a net tension rod and a net system.

FIG. 16 shows the net tension rod 36 being inserted through the net tension rod holder 84, through the side of the net 24, and into the net tension rod socket 72. FIG. 16 further shows how in one aspect, the vertical riser 14 may be curved. FIG. 17 shows another view of the net tension rod 36 inserted into the net tension rod socket 72. This creates tension on the entire net 24.

Figure 18A:
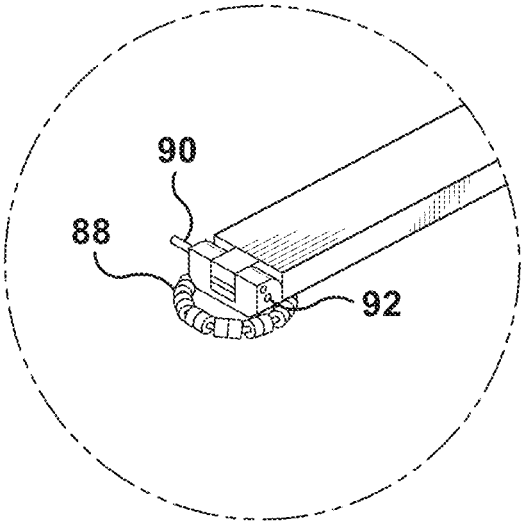
FIG. 18A shows a perspective view of a leg with a wheel in the playing position.
Figure 18B:
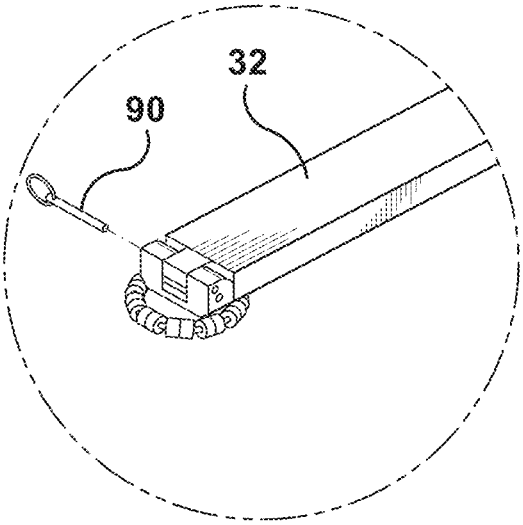
FIG. 18B shows a perspective view of a leg with a wheel with a pin removed where the wheel is in the playing position.
Figure 18C:
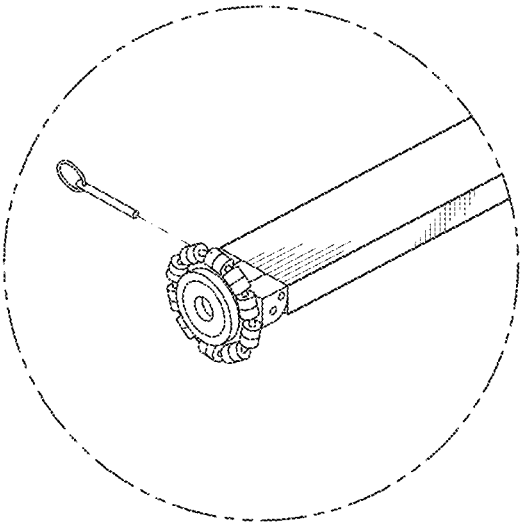
FIG. 18C shows a perspective view of a leg with a wheel with a pin removed where the wheel is in the mobile position.
Figure 18D:
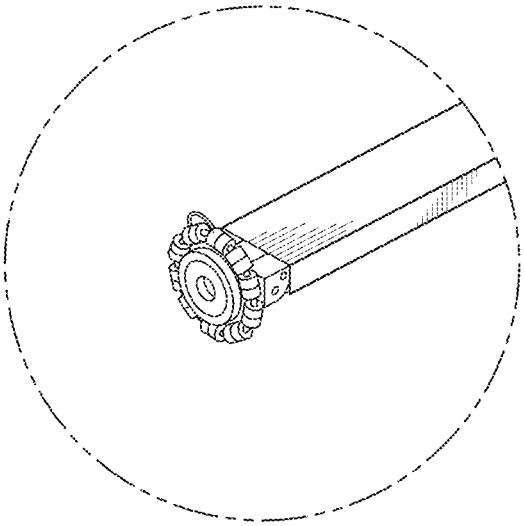
FIG. 18D shows a perspective view of a leg with a wheel with a pin installed where the wheel is in the mobile position.

FIGS. 18A, 18B, 18C, 18D show the leg 32 and a wheel 88 with a pin 90. The wheel 88 may be positioned in a playing position where it serves as a ground contact. In this position, the pin 90 is inserted into a channel 92 to keep the wheel 88 in its position. As shown in FIGS. 18B, 18C, and 18D, with the following method, the wheel 88 can be transformed from a playing position to a mobile position, the method including removing the pin 90 from the channel 92, repositioning the wheel 88 into the mobile position, and reinserting the pin 80 into the channel 92. This repositions the wheel 88 into the mobile position such that the net system 10 may be pushed by a person to move it.

The following method can be used to assemble the net system 10: inserting the end beams 28 into or onto the center beam 30, inserting the pins 38 and attaching the link clips 40, attaching the end beams 28 to the legs 32, optionally by using the leg 32 alignment slots and the end beam 28 mount clips, lifting the frame 22 to have the beam flanges 42 align and to arch the frame 22, inserting the tensioning component 44 through the washer 46, through the barrel washer 48, through the vertical riser aperture 37, through the bushing 50, and into the tension block 34, inserting the assembly of the tensioning component 44, the vertical riser 14, and the tension block 34 into the end beam 28, inserting the hinge pin 62 into the knuckle hinge 74, inserting the cord loop 76 into the slot 56 of the tension block 34, inserting the cord retaining component 54 into the eye 52 of the tension block 34, attaching the top cord 12 to the vertical risers 14, tightening the tensioning component 44, and inserting the net tension rod 36 through the net 24, through the net tension rod holder 84, and into the net tension rod socket 72. It should be understood to a person of ordinary skill in the art that some steps may be rearranged or omitted, and the net system can still be assembled.

Figure 19:
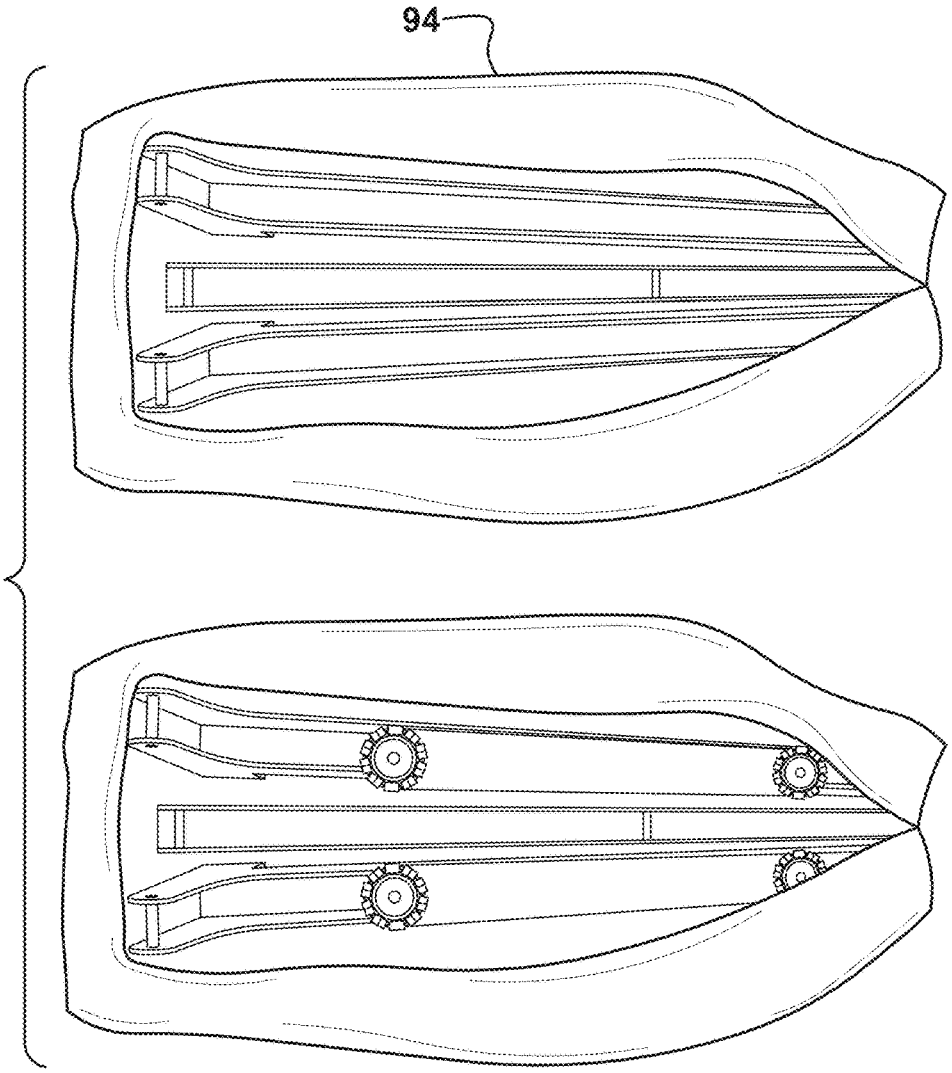
FIG. 19 shows a top-down view of a net system inside a transport bag.
Figure 20:
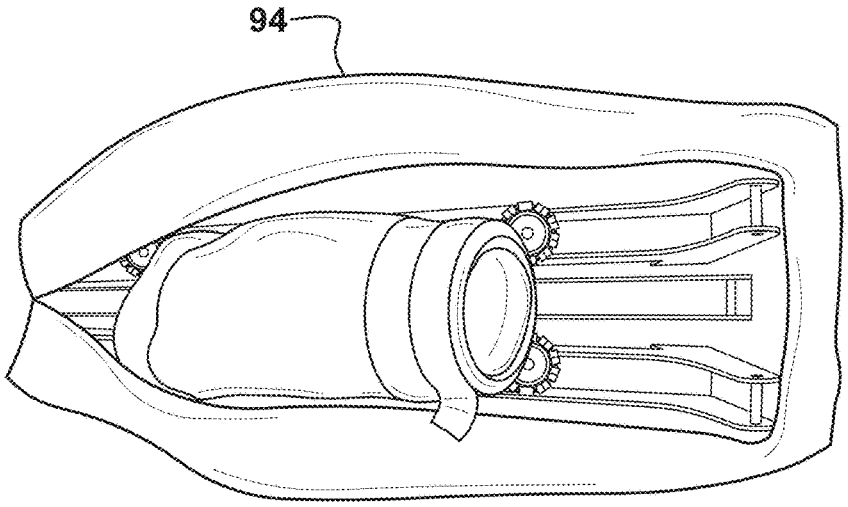
FIG. 20 shows another top-down view of a net system inside a transport bag.
Figure 21:
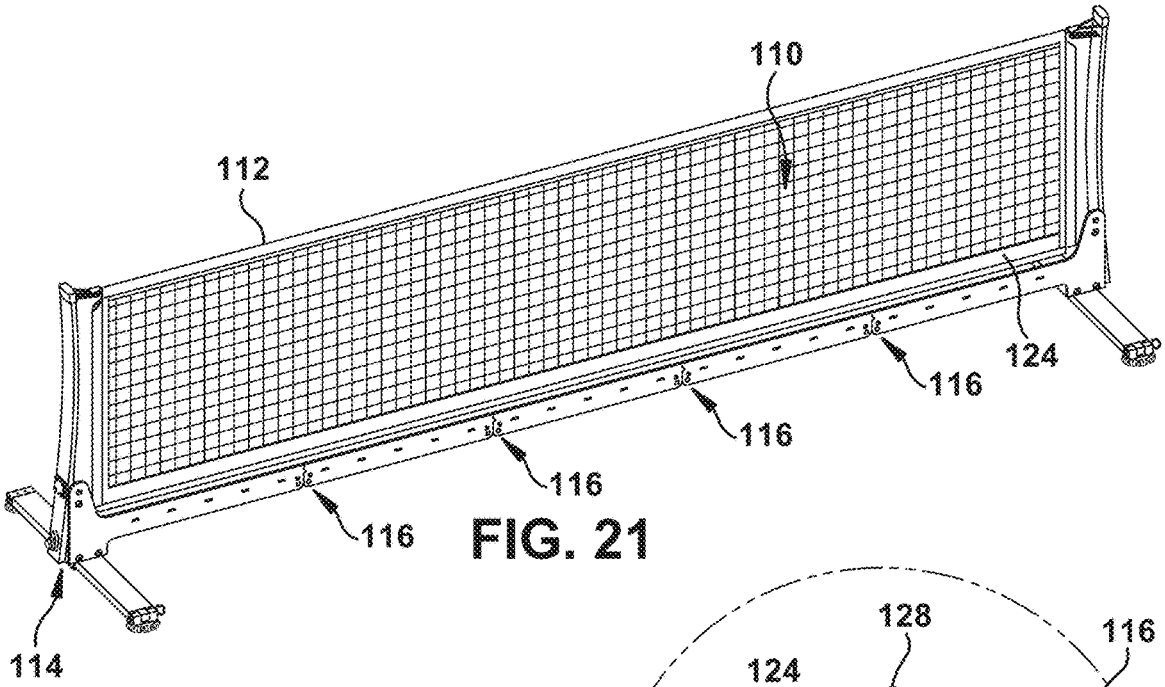
FIG. 21 shows a perspective view of another aspect of a net system.
Figure 21A:
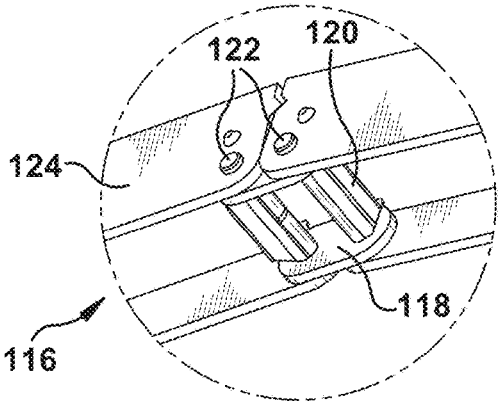
FIG. 21A shows an exploded perspective view of an integral hinge joint.
Figure 21B:
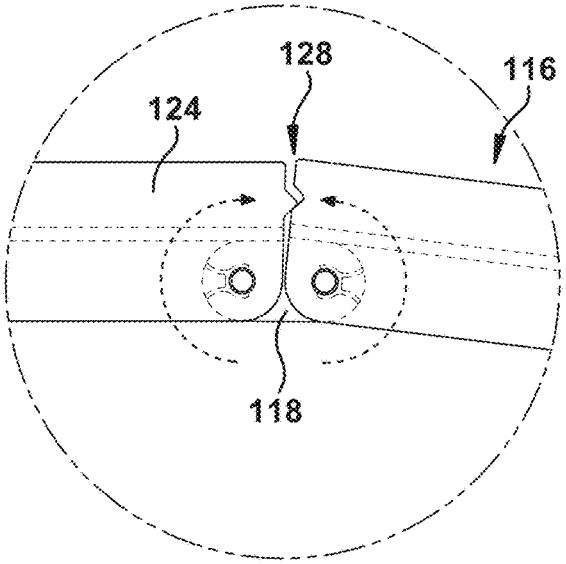
FIG. 21B shows an exploded side view of the hinge joint.
Figure 21C:
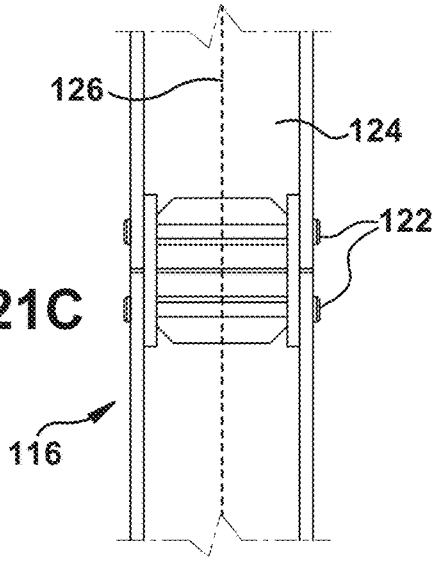
FIG. 21C shows an exploded bottom view of the hinge joint.

FIGS. 19 and 20 show the net system 10 and a transportation bag 94. The net system 10 can easily be disassembled. A person can disassemble the net system 10 by the following method: unloading the net tension by unscrewing the tensioning component 44, removing the top cord 12 from the vertical risers 14, removing the net tension rods 26, removing the cord retaining component 54 from the tension blocks 34, removing the bottom cord 20, removing the hinge clips 70, removing the hinge pins 62, removing the vertical risers 14 from the end beams 28, removing the pins 38 and the link clips 40 from the end beams 28 and the center beam 30, and removing the legs 32 from the end beams 28. As such, in one aspect, each piece of the net system 10 is small enough to fit into the transportation bag 94 such that a person can carry the transportation bag 94. In another aspect, the sum weight of the pieces is light enough so that when the pieces are in the transportation bag 94, a person can carry the transportation bag 94. In another aspect, when the net system 10 is inside the transportation bag 94, the bag and the net system 10 weigh less than 100 pounds. It should be understood to a person of ordinary skill in the art that some steps may be rearranged or omitted, and the net system can still be disassembled.

FIGS. 21, 21A, 21B, 21C show a net system 110, a top tension cable 112, a bottom tension cable 114, integral hinge joints 116, hinge links 118, link spacer clips 120, hinge pins 122, a frame 124, a mid-plane 126, a hinge 128, a load F, a compression point P, and a moment force M. The net system 10 is a tensegrity structure comprised of multiple rigid sections connected together with hinge links 118 and hinge pins 122 to form an integral hinge joint 116. The hinge links 118 are spaced equidistant ($x^1=x^2$) from the mid-plane 126 to provide a balanced transfer of load to the rigid sections when the net system 10 is placed under a bending load. When the frame 124 is loaded by the net tension. The net system 10 is subject to a high bending moment and the hinges 128 are forced to close. The closure produces an unyielding hinge 128 that is resistant to bending and torsion and when combined with the rigid sections produces a long rigid frame 124. The bottom tension cable 114 runs inside and underneath the foldable frame 124. The link spacer clips 120 fix the hinge pins 122 and set hinge link 118 spacing. When the frame 124 sections are assembled together, the frame 124 sections start in a bent form. The hinge links 118 pull the bottom together with load F and pinches at the first compression point P. Tension distributed across the top tension cable 112 and the bottom tension cable 114 creates moment force M that forces the hinge 128 into a locked position.

We claim:

1. A net system comprising:

a frame with a first and second end;

a first and second vertical riser connected to opposite sides of the frame, wherein a proximal end of at least one of the vertical risers is pivotably attached to the frame;

a top cord connected to a distal end of each vertical riser;

a bottom cord connected to the proximal end of each vertical riser, wherein tension on the bottom cord can be adjusted; and a net that is suspended by the top cord, wherein the at least one of the vertical risers pivotally attached to the frame is connected to the frame by a hinge, wherein increased tension on the bottom cord causes the at least one of the vertical risers to pivot about the hinge, transferring load by leverage across a fulcrum created at the hinge, thereby increasing tension on the top cord, wherein the frame is above the bottom cord, wherein the net is not connected to the bottom cord.

2. The net system of claim 1, wherein the bottom cord is attached to a tension block, the tension block is attached to a tensioning component, the first vertical riser has an aperture, and the tensioning component is inserted through the aperture in the first vertical riser and into the tension block.

3. The net system of claim 2, wherein the tensioning component is a threaded screw, the tension block has a socket, and the socket is threaded such that the screwing of the tensioning component or tension block brings the tensioning component and tension block closer to each other.

4. The net system of claim 2, wherein the tensioning component is inserted into an end of the frame, the tension block is positioned inside the frame, and the bottom cord is positioned inside the frame.

5. The net system of claim 1, wherein decreased tension on the bottom cord decreases tension on the top cord.

6. The net system of claim 1, wherein tension of the top cord and the bottom cord is balanced by a vertical riser.

7. The net system of claim 1, wherein the first vertical riser comprises a carbon fiber composite.

8. The net system of claim 1, wherein the first vertical riser is substantially curved.

9. The net system of claim 1, wherein the frame comprises a center beam and two end beams.

10. The net system of claim 2, wherein the frame is compressed by the bottom cord, the tension block, and the tensioning component.

11. The net system of claim 1, wherein the first and second vertical risers are curved, wherein the net system further comprises:

a tension block, wherein the tension block is connected to the proximal end of at least one of the vertical risers;

a tensioning component, wherein the tension block is attached to the tensioning component; and a cord retaining component, wherein the cord retaining component is connected to the tension block the first vertical riser has an aperture, and the tensioning component is inserted through the aperture in the first vertical riser and into the tension block, wherein the bottom cord is attached to the tension block, wherein the bottom cord is held in place by the cord retaining component, wherein the tension block is beneath the frame.

12. A net system comprising:

a frame with a first and second end;

two vertical risers, each pivotably attached to opposite ends of the frame;

a top cord attached to the distal end of each vertical riser;

wherein each vertical riser is connected to the frame by a knuckle hinge positioned above the frame;

wherein each vertical riser further comprises an aperture on its proximal end;

a first tension screw inserted into the aperture on the first vertical riser and inserted into a first threaded tension block;

a second tension screw inserted into the aperture on the second vertical riser and inserted into a second threaded tension block;

a bottom cord connected to the first and second tension blocks, wherein tension on the bottom cord can be adjusted;

a net that is suspended by the top cord; and first and second assemblies of the tension screws, vertical risers, and tension blocks configured so that as the first or second tension screw is tightened, the first or second tension screw biases the proximal end of its respective vertical riser towards the frame end, wherein the at least one of the vertical risers pivotally attached to the frame is connected to the frame by a hinge, wherein increased tension on the bottom cord causes the at least one of the vertical risers to pivot about the hinge, transferring load by leverage across a fulcrum created at the hinge, thereby increasing tension on the top cord, wherein the frame is above the bottom cord, wherein the net is not connected to the bottom cord.

13. The net system of claim 12, wherein the first and second vertical risers are curved, wherein the net system further comprises:

a tension block, wherein the tension block is connected to the proximal end of at least one of the vertical risers;

a tensioning component, wherein the tension block is attached to the tensioning component; and a cord retaining component, wherein the cord retaining component is connected to the tension block the first vertical riser has an aperture, and the tensioning component is inserted through the aperture in the first vertical riser and into the tension block, wherein the bottom cord is attached to the tension block, wherein the bottom cord is held in place by the cord retaining component, wherein the tension block is beneath the frame.

14. A method for tensioning a cord of a net system comprising:

providing a frame with two vertical risers pivotably connected on opposite sides of the frame;

connecting a top cord to the distal end of each vertical riser; and biasing the proximal end of at least one vertical riser towards the frame, by tensioning of a bottom cord, wherein the biasing of the at least one vertical riser toward the frame increases tension on the top cord, wherein the frame is above the bottom cord, wherein a net is not connected to the bottom cord.

15. The method of claim 14, further comprising connecting the bottom cord to each vertical riser.

16. The method of claim 14, further comprising connecting the bottom cord to at least one of the vertical risers so that the top cord and bottom cord are balanced in tension by the at least one of the vertical risers.

17. The method of claim 15, further comprising providing a tensioning component and a tension block, inserting the tensioning component through an aperture in at least one of the vertical risers, inserting the tensioning component into the tension block, and connecting the tension block to the bottom cord.

18. The method of claim 14, wherein at least one vertical riser has a hinge between its proximal and distal ends.

19. The method of claim 17, further comprising positioning the tensioning component inside the frame and positioning the tension block inside the frame.

* * * * *